US005727350A

United States Patent [19]

Marcella

[11] Patent Number: 5,727,350

[45] Date of Patent: Mar. 17, 1998

[54] SELF-CLEANING GUTTER

[76] Inventor: Frank V. Marcella, 13 Stanley St., Pleasantville, N.Y. 10570

[21] Appl. No.: 198,168

[22] Filed: Feb. 16, 1994

[51] Int. Cl.[6] ..... E04D 13/076

[52] U.S. Cl. ..... 52/12; 52/11; 52/16; 239/207; 239/208; 134/166 R; 248/48.1

[58] Field of Search ..... 52/11, 12, 15, 52/16; 239/208, 209, 207, 121, 122, 123, 280, 280.5, 281, DIG. 12, DIG. 13; 134/166 R, 169 R; 248/48.1, 48.2

[56] References Cited

U.S. PATENT DOCUMENTS

| | | | |
|---|---|---|---|
| 929,684 | 8/1909 | Mills et al. | 52/11 |
| 1,313,742 | 8/1919 | Schad | 52/12 |
| 2,271,081 | 1/1942 | Layton | 52/12 |
| 2,624,299 | 1/1953 | Beegle | 52/16 |
| 2,865,674 | 12/1958 | Jelmeland | 52/16 X |
| 2,887,073 | 5/1959 | Thompson | 52/16 |
| 4,183,368 | 1/1980 | Husted | 134/166 R |
| 4,190,988 | 3/1980 | Carreiro | 52/11 X |
| 4,467,570 | 8/1984 | Kriegel | 52/12 |
| 4,590,716 | 5/1986 | Smith | 52/12 |
| 4,631,875 | 12/1986 | Olsen | 52/12 |
| 4,634,312 | 1/1987 | Sterzel | 52/11 X |
| 4,956,948 | 9/1990 | Hart | 52/12 X |
| 4,972,863 | 11/1990 | Morrow | 52/11 X |

FOREIGN PATENT DOCUMENTS

| | | | |
|---|---|---|---|
| 2678013 | 12/1992 | France | 52/11 |
| 527581 | 6/1931 | Germany | 239/122 |
| 53-140628 | 12/1978 | Japan | 52/11 |
| 13010 | 7/1891 | United Kingdom | 52/11 |

*Primary Examiner*—Carl D. Friedman
*Assistant Examiner*—Laura A. Callo
*Attorney, Agent, or Firm*—Lackenbach Siegel Marzullo Aronson & Greenspan, PC

[57] ABSTRACT

The self cleaning rain gutter system of this invention has the quadruple advantage of being easy to install, being clog resistant, being self cleaning, and being without visible slope. Ease of installation is accomplished by modular sections made up of box, gutter and louver rack. These are simply installed level, using the fascia board as a guide as well as a support. A modular section may be installed fully assembled, with preset slope and leader funnel with cleaning water connections—or, at the option of the installer, may be mounted in a two step procedure, first the support box and then the gutter and louver rack. Clog resistance is provided by an integral top grating which interdicts most leaves and twigs as well as the occasional tennis ball. These larger items tend to provide the framework for clogs. The smooth rounded cross section of the bottom of the inner gutter also tends to resist clogging. Self cleaning is accomplished by a system of water channels and dislodging jet nozzles and at least one flow making jet nozzle. When the self-cleaning feature is activated, either manually or automatically, jets of water into the gutter to dislodge and float away to the next down spout whatever small debris have passed through the top louvers. Water to activate the self-cleaning feature may be obtained by connecting a hose and manually opening a valve, or may be automatically obtained by means of either a timer or a rain sensor and electronically controlled valve.

8 Claims, 2 Drawing Sheets

SELF-CLEANING GUTTER

BACKGROUND OF THE INVENTION

1. Field of the Invention

This invention relates to roof gutter systems, and in particular to a roof gutter system which is self-cleaning and clog resistant.

2. Description of the Related Art

Rain gutters for roofs are critical to the well-being of a house. In certain situations, a gutter may be placed at ground level at the drip position under a roof overhang, but in most situations in the United States the roof gutter is placed just outside the overhang of the roof affixed to the fascia board which covers the ends of the rafters, or to the rafter ends without a fascia board. Other gutters may be built into the roof, but such built-in gutters are expensive to make and are disastrous when they eventually fail.

Gutters have been made of wood. Wood makes a substantial gutter with no great likelihood of drooping. The wood gutter is capable of supporting a ladder without denting, but requires frequent painting—and today is prohibitively expensive.

Gutters have been made of copper. Such gutters may be soldered together to form a unitary gutter of high quality and significant length. The copper takes on a characteristic rich brown color and requires no painting—but copper gutters are subject to ladder damage because they are soft. The primary problems with copper gutters are prohibitive expense and theft for copper scrap.

Most gutters today are made of aluminum, factory painted white or brown. Such gutters are subject to ladder damage but with care and cleaning may last indefinitely The gutter is a very visible part of the house, and may be ugly, particularly if mounted with a significant slope to ensure good water carrying. Apparently for reasons having to do with human vision and balance, a steeply sloped gutter is ugly. To combat this ugliness, most gutters today are installed with very small slopes just sufficient to cause water to flow to the lower end for disposal down a leader pipe. Gutters are generally installed by trained installers, who custom-cut and fit the gutter sections and install the gutter sections either directly with big aluminum nails or indirectly with brackets to the fascia boards. Once installed, the gutter sections are quite difficult to move, particularly if nailed without brackets, so adjustments for slope are difficult.

SUMMARY OF THE INVENTION

The object of the self-cleaning rain gutter system of this invention is to gain the quadruple advantage of being easy to install, being clog resistant, being self cleaning, and being without visible slope.

A feature of the invention is ease of installation, accomplished by modular sections made up of box, gutter and louver rack. These are simply installed level, using the fascia board as a guide as well as a support. A section may be installed fully assembled, with preset slope and leader funnel—or, at the option of the installer, may be mounted in a two step procedure, first the support box and then the gutter and louver rack.

A second feature of the invention is clog resistance, provided by an integral top grating which interdicts most leaves and twigs as well as the occasional tennis ball. These larger items tend to provide the framework for clogs. The smooth rounded cross section of the bottom of the inner gutter also tends to resist clogging.

Another feature of the invention is serf cleaning, accomplished by a system of water channels and nozzles which, when activated either manually or automatically, spray jets of water into the gutter to pry loose and float away to the next down spout whatever small debris have passed through the top louvers. Water for self-cleaning may be by manually opening a valve and connecting a hose, or may be automatic by means of either a timer or a rain sensor and electronically controlled valve.

The advantage of the invention is that gutters may be cleaned without climbing and without much effort.

DRAWINGS

DESCRIPTION OF A PREFERRED EMBODIMENT

Figures 1, 2:
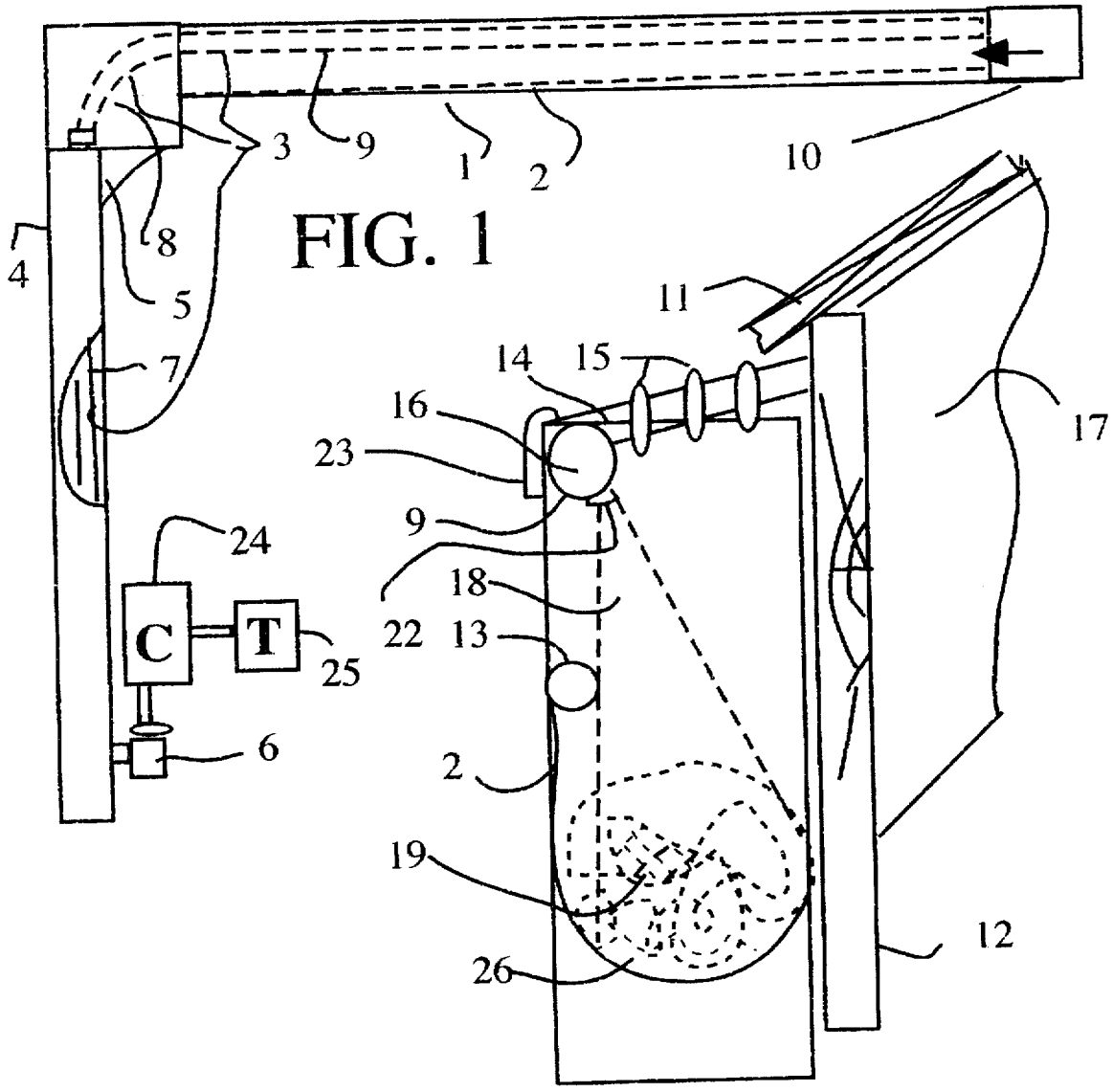
FIG. 1 is a side elevation view of the self cleaning gutter system in place.
FIG. 2 is an end view of the gutter system in place.

FIG. 1 shows a self cleaning rain gutter system module of the invention. Gutter support box 1 encloses gutter 2 and gutter cleaning water channel subsystem 3. Leader 4 accepts a flow of water (with or without debris) at leader funnel 5 which has connection means for the gutter cleaning water channel subsystem 3. Leader 4 includes a self cleaning activation control valve 6, at a convenient height for connection and manual activation. Leader 4 consists of its major lumen, for carrying water from gutter to ground, and also contains a cleaning water riser 7 as a second lumen which is not normally visible. This cleaning water riser 7 connects via cleaning water elbow 8 to cleaning water jet supply channel 9. Cleaning water jet supply channel 9 extends along the length of gutter 2 to a flow making end cap 10, with support means for connecting to a self-cleaning gutter louver rack (14) and connection means for connecting to a louver rack integral cleaning water supply channel (16). The self cleaning gutter subsystem 3 includes the self-cleaning activation control valve 6, cleaning water riser 7, cleaning water elbow 8, cleaning water jet supply channel 9 and flowmaking end cap 10, plus appropriate supports and controls. The subsystem may be marketed as a retrofit subsystem module, to be used with existing gutters. Gutter 2 fits snugly inside gutter support box 1 for several reasons having to do with ease of installation and watertight integrity. Gutter 2 preferably has a gutter strengthening roll 13 to make contact with the outside portion of the gutter support box 1.

FIG. 2 shows the self cleaning gutter system in a cutaway end view. The roof 11 and fascia 12 are apparent. Gutter support box 1 and gutter 2 are apparent. Note gutter strengthening roll 13, which provides strengthening to gutter support box I as well as forming a water seal. Gutter 1 may be fixed in place by the snug fit, until the proper slope has been achieved, and then can be fixed in place against fascia 12 by nails or screws not shown.

Figure 3:
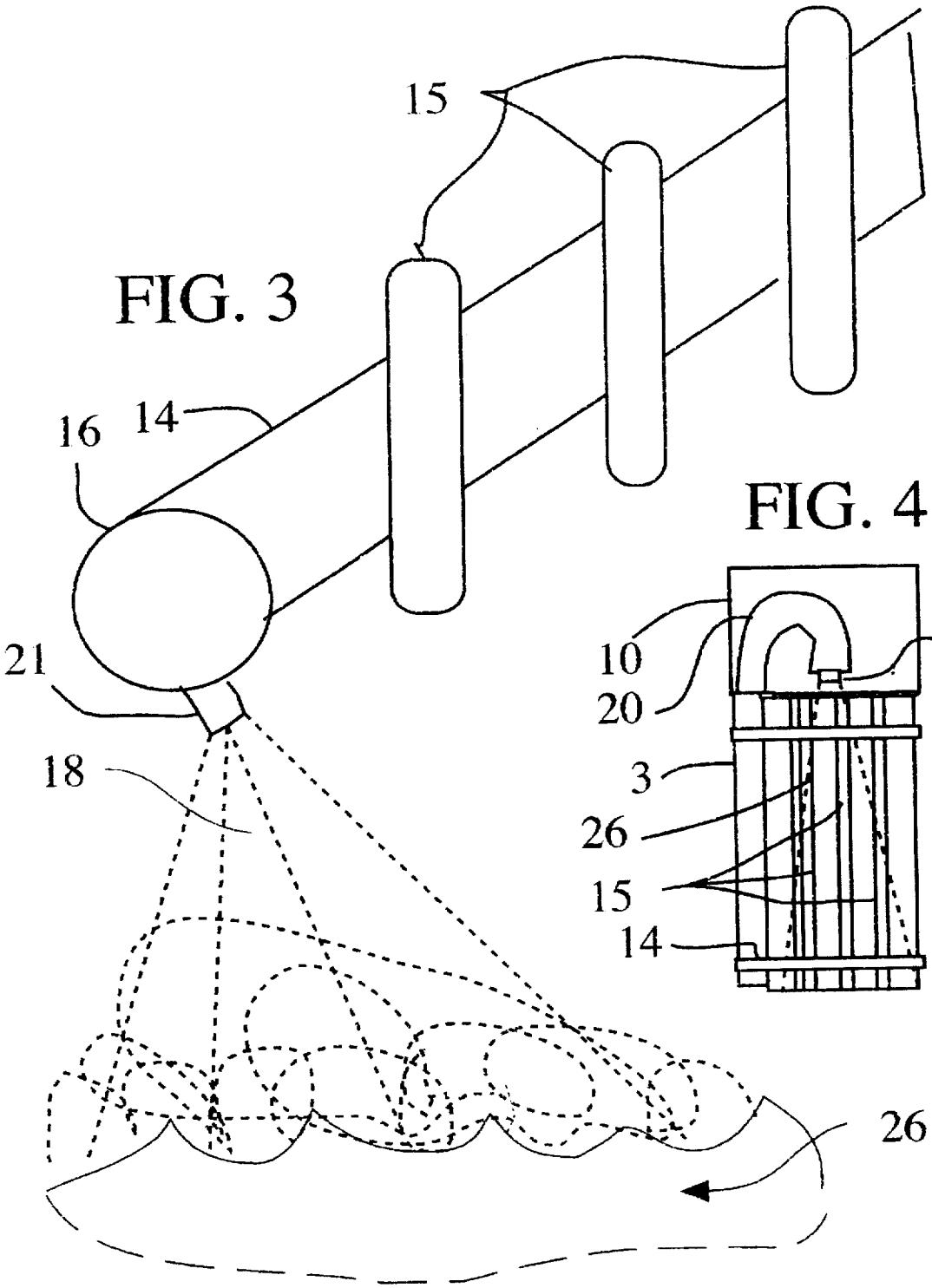
FIG. 3 is an end view of the louver rack.
Figure 4:
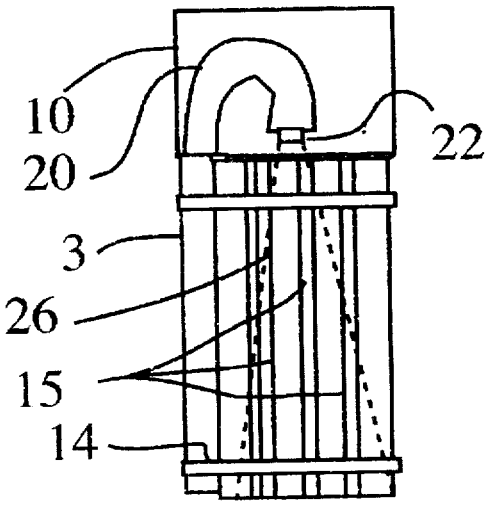
FIG. 4 is a plan view of the louver rack showing the turnaround of the cleaning water channel and the flow making jet nozzle.

Louver rack 14 is apparent in FIG. 2, but is shown enlarged and in greater detail in FIG. 3. Louver rack 14, louvers 15 and louver rack integral cleaning water supply channel 16 cooperate, as shown in FIG. 3, to achieve the following functions:

water entry large debris rejection gutter support box 1 strengthening dislodging jet support and supply Another function of louver rack 14 is to carry water out to the distal end of the module to feed cleaning water to the flow making jet nozzle. This function is shown in FIG. 4. Louver rack 14 is at an angle approximating that of the slanted roof 11, to aid water flow and debris rejection. It is preferred to supply the cleaning water through cleaning water riser 7 within leader 4, primarily for visual appearance reasons, but the cleaning water supply channel subsystem may also be connected at the high end of a gutter module by a hose connection or other appropriate means.

Gutter support box 1 may be rectangular, or may be shaped with its inner side higher than its outer side to provide automatically for the slope of the louver rack 14. Louvers 15 appropriately are set at an angle to louver rack 14 to ensure that louvers 15 are approximately vertical or angled slightly toward the fascia to direct water from the roof 11 downward into gutter 2. Modularity is achieved by having a small array of module lengths, each with the configuration of FIG. 1. The system may also be built up on location from individual parts.

The louver rack subsystem is preferably manufactured with louver racks 14 bridging the top of the gutter support box 1 with louvers 15 extending longitudinally to the related gutter, generally on 1–2 centimeter centers, and with louver rack integral cleaning water supply channel 16 which serves both as physical support and cleaning water jet supply channel 9 (FIG. 1). FIG. 2 shows fascia board 12 and rafter end 17, as well as dislodging spray 18 and debris 19 in gutter 2, floating atop cleaning flow 26.

FIGS. 3 and 4 show greater detail of the louver rack subsystem. Flowmaking turnabout 20 (FIG. 4) and dislodging jet nozzle 21 are sources respectively of flow water delivered with velocity at the high end of the module gutter and dislodging jets 18 arrayed along the gutter to stir up the debris and lift the debris for floatation by the flow water, down the gutter and leader 4 to the ground. The flowmaking turnabout 20 has a flowmaking jet nozzle 22. Nozzles 21 and 22 do not have to be fancy, and may simply be a series of punched holes 21 as dislodging jet nozzles and may simply be a slightly constricted pipe end for flowmaking jet nozzle 22. Actual nozzles of quality material are preferred, however, particularly if they provide some adjustability. Flowmaking jet nozzle 22 is constricted so as to maintain water pressure sufficient to operate dislodging jet nozzles 21. This louver rack integral cleaning water supply channel configuration is preferred, although it is also possible to have separate feed pipes for dislodging jet nozzles 21 and the flowmaking jet nozzle 22. Louver rack cramp 23 is preferred for holding the louver rack in place against the outside top of gutter support box 1.

Cleaning water is preferably turned on manually, but may be operated from a remote location or automatically as desired. FIG. 1 shows cleaning water activation control 24 and timer 25. The gutter cleaning may be set, using standard timing techniques not shown, or using rain sensing built into the control 24, to provide an automatic cleaning cycle with cycle duration controlled by timer 25. Cleaning water flow 26 carries debris 19 downward through leader funnel 5 and leader 4 to the ground.

EXAMPLE I

On a bright, sunshiny day, the homeowner determines to clean the gutters. He opens self-cleaning activation control valve 6 (FIG. 1) and makes a mental note to remember to turn it off in a few minutes. Cleaning water flows into the gutter cleaning water channel 3, starting at cleaning water riser 7, passes through cleaning water elbow 8, and enters cleaning water channel 9. When the cleaning water channel 9 is essentially full, cleaning water begins to spray out of dislodging jet nozzles 21 and flowmaking jet nozzle 22. The dislodging jet sprays 18 undermine the dry debris in the gutter 2, preferably while the dislodged debris 19 is still dry, causing dislodged debris 19 to float on the water flow 24 provided by a cleaning water flow from flowmaking jet nozzle 22. The cleaning water flow carries floating debris to the leader 4, discharging such debris onto the ground. The cleaning water flow also lubricates the gutter 2, pushing nonfloating debris toward the leader 4, and discharging such nonfloating debris onto the ground. Pristine cleaning water begins to flow out of the leader 4. The homeowner turns off self cleaning activation control valve 6, and celebrates a formerly messy job easily done.

EXAMPLE II

Rain starts, activating cleaning water automatic activation control 24, which opens self cleaning activation control valve 6. Everything operates as in EXAMPLE I, except that the rain speeds the process. Cleaning water automatic activation control 24 has a timer 25 built in, to eliminate excessive cleaning water flow. This timer 25 may be an automatic cycling timer, and provide for another shot of cleaning water every 15 minutes (or other time duration selected) during the rain. Timer 25 may also be set to operate for a self cleaning cycle monthly, whether or not it rains.

The invention has been shown in context of a preferred embodiment and variations for retrofit, for modularity, and for manual or automatic operation. Other variations will be apparent to those skilled in the art, without departing from the spirit and scope of the invention.

What is claimed is:

1. A self cleaning gutter system for cleaning debris therein and being mounted in juxtaposition to a roof having a slope, comprising:

a) an elongated open-top rectangular cross section support box (1) for mounting against a rafter end or fascia of a building in a generally rain gutter mounting position, but substantially level;

b) a gutter member (2) mountable so as to be fixedly retained in place within said support box (1) with a predetermined slope appropriate for water disposal, and said gutter member (2) having a rounded bottom cross section;

c) a louver rack (14) mounted at an angle similar to said slope of said roof, and being removably mountable atop said support box and providing closure for said support box (1); said louver rack having elements bridging said support box and supporting a plurality of louvers for diverting rain water into said gutter member;

d) said gutter member (2) is provided with a flutter strengthening roll element (13), for strengthening said support box (1) by making contact with an inside portion of said support box and for forming a water seal with said support box; and e) a gutter cleaning water channel subsystem means (3) extending substantially the length of said support box (1), having a water connection end and a distal end, and having a plurality of dislodging jet nozzles (21) along its length and a flow making jet nozzle (22) at said distal end, and being mountable in position to deliver water from said dislodging jet nozzles (21) to cause said debris to be dislodged from both sides and bottom of the gutter member (2) and to deliver cleaning water from said flow making jet nozzle (22) to carry away said debris dislodged by said plurality of dislodging jets (21); whereby said slope of said gutter member is concealed by said support box which is mounted in an aesthetically pleasing and substantially level position.

2. A self cleaning gutter system for cleaning debris therein, comprising:

a) an elongated support box (1) for mounting against a rafter end or fascia of a building in a generally rain gutter mounting position, but substantially level;

b) a gutter member (2) mountable with a snug fit within said support box (1) with a slope appropriate for water disposal, and said gutter member (2) having a rounded bottom cross section;

c) a louver rack (14), mountable and demountable atop said support box (1) by clamp means without contacting said gutter member (2), containing a plurality of louvers (15) mounted longitudinally to the gutter member along its length, and d) a gutter cleaning water channel subsystem means (3) comprising a cleaning water supply channel (16) integral with said louver rack, which serves also as a support member, extending substantially the length of said support box (1), having a water connection end and a distal end, and having a number of dislodging jet nozzles (21) along its length and a flow making jet nozzle (22) at its distal end, and being mountable in position to deliver water from said dislodging jet nozzles (21) to cause said debris to be dislodged from side and bottom of said gutter member (2) and to deliver cleaning water from said flow making jet nozzle (22) to carry away said debris dislodged by said dislodging jets (21).

3. A self-cleaning gutter system according to claim 2, in which said gutter member (2) is permanently attached within said support box (1) with an appropriate standard drainage slope and said support box (1) and said louver rack (14) have a selected permanent standard slope matched to that of a selected standard roof slope.

4. A self cleaning gutter system module, comprising:

a) an elongated open-top rectangular cross section support box (1) for mounting against a rafter end 8 fascia of a building, in a generally rain gutter mounting position, but substantially level;

b) a gutter member (2) mountable with a snug fit within said support box (1) with a slope appropriate for water disposal, said gutter member (2) having a rounded bottom cross section;

c) a louver rack (14) subsystem mountable atop and providing closure for said support box (1);

d) a gutter cleaning water channel subsystem means (3) comprising a cleaning water supply channel (16) integral with said louver rack, which serves also as a support member, extending substantially the length of said support box (1), having a water connection end and a distal end, and having a number of dislodging jet nozzles (21) along its length extending substantially the length of said support box (1), and a flow making jet nozzle (22) at its distal end, and being mountable in position to deliver water from said dislodging jet nozzles (21) to cause debris to be dislodged from side and bottom of said gutter member (2) and to deliver cleaning water from said flow making jet nozzle (22) to carry away debris' dislodged by said dislodging jets (21); and e) leader funnel means (5) having connection means for said gutter cleaning water channel subsystem means.

5. A louver rack for a support-box-enclosed self-cleaning gutter for use in cleaning debris accumulated therein, comprising: a main cleaning water supply channel (16) associated with said support-box-enclosed self-cleaning gutter, serving both as a physical support member extending substantially along its length and a cleaning water jet supply passageway (9), and said channel (16) having a water connection end and a distal end, and having a plurality of dislodging water jet nozzles (21) therebetween and having a turnabout flowmaking end cap (10), with a flowmaking jet nozzle (22), at said distal end, and being mountable in a position to deliver water from said dislodging water jet nozzles (21) to cause said debris to be dislodged from all sides and bottom of a gutter member (2) and to deliver said water from said flowmaking jet nozzle (22) to carry away said debris dislodged by said water and turnabout flowmaking end cap (10) for the self-cleaning gutter.

6. A louver rack according to claim 5, wherein said louver rack including a plurality of bridge elements disposed transverse to said support-box-enclosed self-cleaning gutter, and a plurality of louvers supported thereon for diverting rain water into said gutter.

7. The louver rack according to claim 6 wherein said plurality of louvers extend longitudinal to said gutter member, and are on about 1 to about 2 centimeters centers.

8. A louver rack subassembly, comprising: a support-box-enclosed self-cleaning gutter for use in cleaning debris accumulated therein, integral with a cleaning water supply channel (16), serving also as a support member, extending substantially along its length, having a water connection end and a distal end, and having a number of dislodging jet nozzles (21) along its length and, having support means (14) for connecting to said self-cleaning gutter support box (1), and having connection means for connecting to a louver rack having an integral cleaning water supply channel (16).

* * * * *